United States Patent [19]

Adams

[11] Patent Number: 4,542,930

[45] Date of Patent: Sep. 24, 1985

[54] RIGID TUBE TYPE BEVERAGE CAN CARRIER

[76] Inventor: Mark S. Adams, Indian Trail, R.F.D. 1, New Milford, Conn. 06776

[21] Appl. No.: 569,251

[22] Filed: Jan. 6, 1984

[51] Int. Cl.[4] ..... B65D 71/00

[52] U.S. Cl. ..... 294/160; 206/427; 220/23.4; 294/137; 294/162

[58] Field of Search ..... 294/87 R, 87.2, 87.28, 294/137, 146, 141-143, 159-164, 167; 206/139, 140, 144, 170, 192, 201, 203, 427, 428, 430; 220/23.2, 23.4; 221/91, 281, 303, 306; 229/17 B; 312/45, 72

[56] References Cited

U.S. PATENT DOCUMENTS

| | | | |
|---|---|---|---|
| 1,975,428 | 10/1934 | John | 206/430 |
| 2,361,077 | 10/1944 | Albrecht | 206/427 |
| 2,485,275 | 10/1949 | Geller | 221/306 X |
| 3,131,829 | 5/1964 | Masser | 206/144 |
| 3,164,185 | 1/1965 | Ingoldt | 294/159 |
| 3,263,806 | 8/1966 | Ring | 206/427 |
| 3,362,577 | 1/1968 | Singer et al. | 294/161 X |
| 3,498,523 | 3/1970 | Stembridge et al. | 206/203 X |
| 4,300,697 | 11/1981 | Dickens | 294/159 X |

FOREIGN PATENT DOCUMENTS

| | | | |
|---|---|---|---|
| 2304542 | 11/1976 | France | 294/161 |
| 703197 | 4/1966 | Italy | 206/144 |

*Primary Examiner*—Johnny D. Cherry
*Attorney, Agent, or Firm*—Harvey B. Jacobson

[57] ABSTRACT

A carrier for returnable beverage containers such as metal cans of aluminum or the like and bottles which includes a plurality of substantially rigid tubes connected together by clips or other connectors to form the carrier. Each of the tubes is vertically elongated to receive a plurality of vertically oriented containers in stacked relation. Carrying handle structure is attached to the carrier to enable it to be easily carried and the bottom ends of the tubes have a retainer which can be rendered ineffective to enable the returned containers to be discharged by gravity from the lower ends of the tubes thereby enabling a plurality of returnable containers to be easily returned to the point of purchase for refund of a deposit with the modular construction of the tubes and the interconnecting clip arrangements enabling variation in the capacity of the carrier.

11 Claims, 5 Drawing Figures

RIGID TUBE TYPE BEVERAGE CAN CARRIER

BACKGROUND OF THE INVENTION

1. Field of the Invention

The present invention generally relates to a carrier for returning beverage containers to the point of purchase to obtain a refund of a deposit that was paid when the beverages were purchased with the carrier being in the form of a plurality of substantially rigid tubes constructed of plastic, rubber or similar material which are interconnected to enable selection of the number of tubes to be assembled into a carrier with a handle being connected to the carrier to facilitate handling of the device. The tubes are elongated so that each of them can receive a plurality of vertically stacked containers and the lower ends of the tubes have an openable closure to enable the tubes to be opened for gravity discharge of the containers to enable the containers to be inspected as to whether an initial deposit was paid.

2. Description of the Prior Art

Various types of carriers and packaging arrangements have been provided for beverages to facilitate a customer carrying the beverages from the point of purchase to a point of consumption including foldable cardboard carriers for use with a limited number of bottles, six pack packaging arrangements and similar arrangements by which cans and bottles containing beverages may be more effectively handled. While returnable bottles have been in existence for many years and are used due to cost effectiveness, as a matter of convenience, many beverages are consumed from disposable or throwaway metal cans which are frequently disposed of alongside roadways and the like and add to a substantial solid waste problem. Recent efforts have been made to induce consumers to return the cans with many jurisdictions enacting ordinances or legislation requiring that a deposit be paid at the time of purchase of a beverage can or bottle so that when the contents of the can or bottle have been consumed, the container can be returned for a refund of the deposit. While beverages can be easily packaged in grocery bags and the like prior to their consumption, when empties are being returned, frequent problems occur due to residual liquids in the containers being discharged interiorly of the bag which causes destruction of the bag. Various efforts have been made to provide more effective carriers for bottles and cans with the following U.S. patents being exemplary of the prior art in this field of endeavor.

| | |
|---|---|
| 1,975,428 | 10/2/34 |
| 3,164,185 | 1/5/65 |
| 3,311,294 | 3/28/67 |
| 3,362,577 | 1/9/68 |
| 4,193,525 | 3/18/80 |
| 4,212,377 | 7/15/80 |
| 4,280,336 | 7/28/81 |
| 4,290,525 | 9/22/81 |
| 4,299,324 | 11/10/81 |
| 4,300,697 | 11/17/81 |

SUMMARY OF THE INVENTION

An object of the invention is to provide a carrier for returnable beverage containers which includes an assembly of a plurality of substantially rigid, vertically elongated tubes connected together in side-by-side relation to provide a plurality of vertical receptacles or compartments which are open at the top and closed at the bottom with each vertical receptacle compartment receiving a plurality of beverage cans or bottles oriented in vertically stacked relation.

Another object of the invention is to provide a carrier in accordance with the preceding object in which the tubes are constructed of plastic, rubber or similar inexpensive material with connectors securing the tubes together to enable variation in the number of tubes assembled into a carrier.

A further object of the invention is to provide a carrier in accordance with the preceding objects in which a carrying handle is attached to the carrier to facilitate handling thereof and the tubes have bottom end structure which retains the containers in the tubes but which can be easily removed to enable gravity discharge of the containers from the lower ends of the tubes.

Still another object of the invention is to provide a carrier in accordance with the preceding objects in which the components of the carrier are relatively inexpensive and can be assembled in a desired relationship to provide an inexpensive, effective and long lasting carrier for returnable containers such as aluminum cans, bottles and the like.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
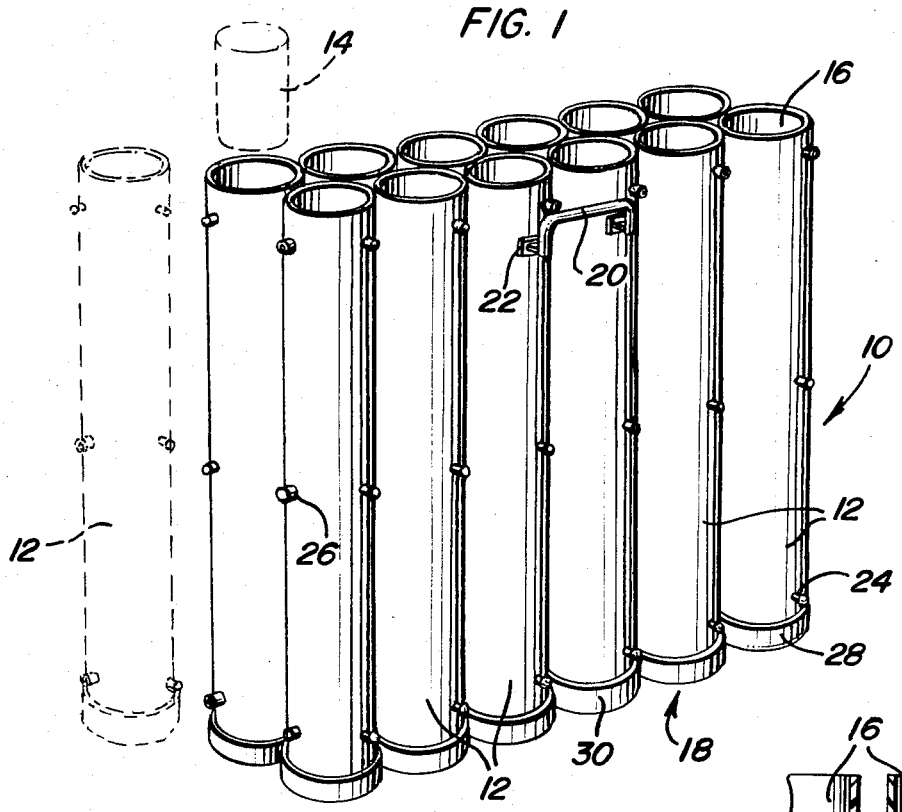
FIG. 1 is a perspective view of the carrier of the present invention.

Referring now specifically to the drawings, the carrier of the present invention is generally designated by the numeral 10 and is constructed of a plurality of substantially rigid tubes 12 which have an internal diameter of a size to freely slidably receive a plurality of beverage cans 14 or the like in vertically stacked relation with the tubes 12 also adapted to receive returnable beverage bottles or the like with the internal dimensions of the tubes 12 being such as to closely receive the periphery of the cans and bottles so that when they are dropped into the tubes, they will slowly descend to the bottom thereof. The upper end of each of the tubes 12 is open as at 16 and the lower end thereof is closed or provided with a retainer generally designated by the numeral 18. Each of the tubes 12 is constructed of molded or extruded plastic, rubber, metal or the like and is substantially rigid in construction and is elongated so that it can be easily carried by a handle 20 attached to adjacent tubes 12 by pivot brackets 22 in a conventional manner similar to the manner in which a handle is attached to luggage and the like with the length of the tubes being such that the lower ends thereof will be spaced from the ground surface when the carrier 10 is carried in the nature of luggage.

A plurality of the tubes 12 may be assembled in modular form by providing a detachable connection between adjacent tubes with the detachable connection including projections 24 and sockets 26 with the projections 24 being headed and the sockets 26 having inturned free edges to frictionally and releasably receive and grip the headed projections 24 thereby providing a snap engagement between adjacent tubes 12 to enable them to be rigidly and fixedly interconnected and separated when desired thereby facilitating assembly of a predetermined number of tubes 12 to form the carrier 10.

Figure 5:
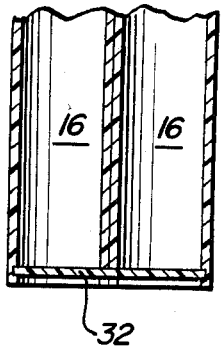
FIG. 5 is a fragmental sectional view illustrating a slide plate closure for the lower ends of the tubes.
Figure 2:
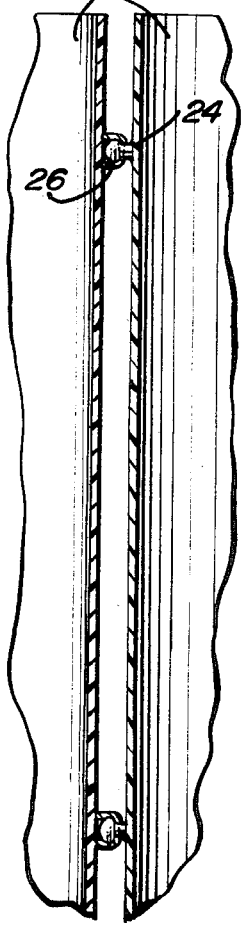
FIG. 2 is a vertical sectional view of two adjacent tubes illustrating the connectors for securing adjacent tubes together.
Figure 3:
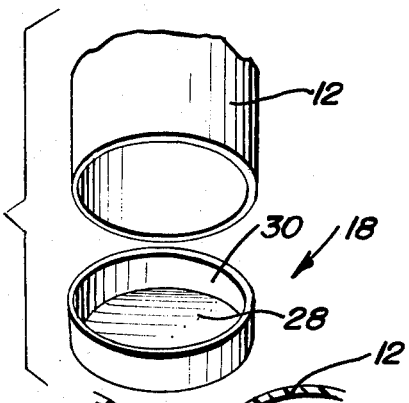
FIG. 3 is a fragmental perspective view of a lower end of one of the tubes illustrating a closure member associated therewith.
Figure 4:
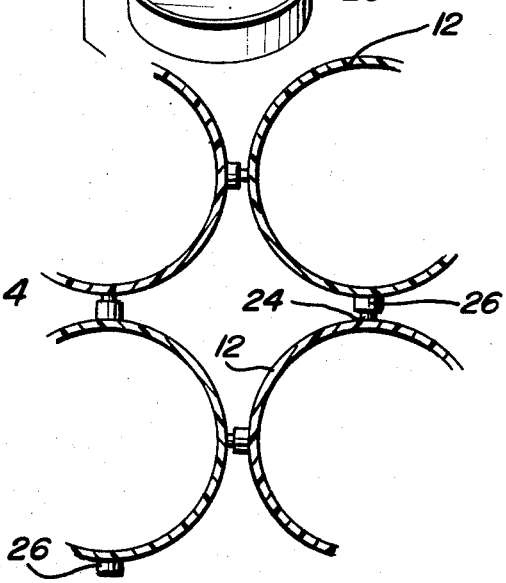
FIG. 4 is a fragmental plan sectional view of a portion of the carrier illustrating the relationship between adjacent tubes.

The retainer 18 at the lower end of the tubes may be a friction-fitted cap 28 having a flange 30 telescopically engaging tube 12 as illustrated in FIG. 3. The cap flange 30 may be internally threaded and the external surface of the tube 12 may be threaded to provide a threaded connection or a bayonet type of interconnection may be provided. Alternatively, the lower end of the tubes 12 may be closed by a pivoting closure door with a manually operated latch with another alternative being a slide plate type of closure for the lower end of each of the tubes 12. When a predetermined number of tubes 16 are to be assembled permanently a single slide plate 32 may be provided for all of the tubes, as shown in FIG. 5, so that by removal of the single plate type closure, all of the tubes may be opened. Alternatively, the tubes may have a wire rod extending diametrically through the bottom thereof, such as through diametrically aligned holes so that the wire rods will enable air circulation through the tubes and also enable easy discharge of the containers from the tubes when the wire rods are removed. Such wire rods may be associated with individual tubes or may be extended through a plurality of assembled tubes. The structure which forms a closure or retainer for the lower ends of the tubes may be provided with an actuator adjacent the handle 20 to further facilitate removal of the returnable bottles or cans thereby enabling the bottles or cans to be inspected to see if in fact a deposit had been paid at the time of purchase inasmuch as each of the bottles or cans will be provided with appropriate indicia indicating that such a deposit was paid.

In the assembly of the carrier, the tubes 12 may be arranged in one row of six tubes with the handle attached to the two central tubes. If desired, an additional row or rows of tubes may be connected to the original six tubes thus forming an assembly of twelve or any other number of tubes desired commensurate with each of handling and carrying. Constructing the tubes of plastic or other material impervious to liquids eliminates problems which could be encountered when returnable containers are inserted so that residual liquid therein drains from the containers within the carrier. The device is easy to maintain in a clean condition and provides a convenient storage for returnable containers while beverages are being consumed from additional containers so that when the carrier is filled with empty containers, it along with the containers can be easily carried back to the point of purchase for obtaining a refund of the originally paid deposit.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be restored to, falling within the scope of the invention.

What is claimed as new is as follows:

1. A carrier for beverage containers comprising a plurality of rigid tubular members oriented in side by side coextensive relation, means rigidly and detachably connecting said tubular members, means forming a movable retainer for the lower ends of said tubular members with the upper ends being open to receive vertically oriented containers to enable insertion of the containers into the open upper ends of the tubular members and gravity discharge from the lower ends thereof, and handle means attached to said tubular members to enable the carrier to be carried.

2. The structure as defined in claim 1 wherein said means connecting said tubular members includes coacting clip means oriented at vertically spaced intervals and circumferentially spaced intervals on the tubular members.

3. The structure as defined in claim 2 wherein said tubular members are cylindrical tubes of plastic material having a vertical length sufficient to receive a plurality of vertically stacked containers and an internal diameter closely receiving returnable containers to enable vertical sliding movement of the containers within the tubes.

4. The structure as defined in claim 3 wherein said retainer means includes a movable member forming a barrier to preclude exit of containers from the lower ends of the tubes, said movable barrier including a structure which extends interiorly of the tubes sufficient to prevent egress of containers from the lower ends of the tubes and being movable to a position to enable discharge of containers from the lower ends of the tubes.

5. The structure as defined in claim 4 wherein said movable member includes an independent closure cap for the lower end of each tube with means securing the closure cap to the tube.

6. The structure as defined in claim 4 wherein said movable member includes a single slide plate in underlying engagement with the lower ends of a plurality of tubes.

7. In combination, a carrier comprising a plurality of substantially rigid tubes of substantially equal length and having a substantially constant internal cross sectional area throughout their length, each of said tubes having an open upper end and a length receiving a plurality of returnable beverage containers vertically inserted into the open upper end of the tube and oriented in vertically stacked relation, the external cross sectional area of the containers being only slightly smaller than the internal cross-sectional area of the tubes for retaining the containers in vertically aligned relation, each of said tubes having an open lower end through which the containers may be discharged by gravity, manually operated means forming a removable barrier at the lower ends of the tubes to retain the containers until returned to a collection point, means detachably interconnecting the tubes and retaining them in assembled side-by-side relationship and handle means on at least one of said tubes adjacent the upper end thereof to enable the assembled tubes to be carried.

8. The combination as defined in claim 7 wherein said interconnecting means includes a plurality of longitudinally spaced and circumferentially spaced cooperating fastener elements on the periphery of each tube to enable the tubes to be assembled in multiple selected arrangements.

9. The combination as defined in claim 8 wherein said means forming a barrier includes an end cap removably mounted on the lower end of each tube to enable selective unrestricted gravity discharge of containers from each tube, said tubes and containers being cylindrical in configuration, said tubes being constructed of plastic material with the fastener elements being of unitary construction with the tubes and including alternating rows of male ball-type members and female socket-type members, each tube including four longitudinal rows of fastener elements spaced equally both longitudinally and circumferentially to enable the tubes to be assembled in side-by-side rows, said handle means including a rigid member bridging and connected to the external periphery of a pair of adjacent tubes to enable the assembled tubes to be carried with the open upper ends positioned above the lower ends.

10. The combination as defined in claim 7 wherein said means forming a barrier includes an end cap removably mounted on the lower end of each tube to enable selective unrestricted gravity discharge of containers from each tube.

11. The combination as defined in claim 7 wherein said means forming a barrier includes a plate forming a closure for the lower ends of all of the tubes and means movably supporting the plate from the tubes to enable movement of the plate to enable unrestricted gravity discharge of containers from all of the tubes.

* * * * *